United States Patent [19]

Houle et al.

[11] Patent Number: 5,053,307

[45] Date of Patent: Oct. 1, 1991

[54] PROCESS FOR PREPARING HIGH GLOSS ELECTROSTATIC LIQUID DEVELOPERS

[75] Inventors: William A. Houle, Kimberton; Gregg A. Lane, Kennett Square, both of Pa.; Carolyn C. Legere-Krongauz, Claymont, Del.

[73] Assignee: DXImaging, Lionville, Pa.

[21] Appl. No.: 516,005

[22] Filed: Apr. 26, 1990

[51] Int. Cl.[5] ..... G03G 9/00

[52] U.S. Cl. ..... 430/137; 524/901; 525/930

[58] Field of Search ..... 430/137, 135; 524/901; 525/930

[56] References Cited

U.S. PATENT DOCUMENTS

| | | | |
|---|---|---|---|
| 4,670,370 | 6/1987 | Taggi | 430/137 |
| 4,760,009 | 7/1988 | Larson | 430/137 |
| 4,923,778 | 5/1990 | Blair et al. | 430/137 |

FOREIGN PATENT DOCUMENTS 2169416 7/1986 United Kingdom .

*Primary Examiner*—David Welsh
*Assistant Examiner*—S. Rosasco

[57] ABSTRACT

Process for the preparation of toner particles for electrostatic liquid developers, which upon fusing to paper have a gloss ≧10 units over the paper gloss comprising:

(A) dispersing at least one thermoplastic resin, at least one pigment, and a hydrocarbon liquid having a Kauri-butanol value of greater than 120 such that the dispersion contains 10% or more by weight solids by means of particulate media whereby the moving particulate media creates shear and/or impact while maintaining the temperature for 5 to 180 minutes in the vessel at a temperature of at least 15° C. above the point at which the resin is plasticized or liquified by the hydrocarbon liquid and below that at which the hydrocarbon liquid boils and the resin and/or pigment decomposes, (B) continuing dispersion of the resin, pigment and hydrocarbon liquid as in Step (A) while maintaining the temperature for 5 to 180 minutes in the vessel at least 5° C. below the point to at least 10° C. above the point at which the resin is no longer plasticized or liquified by the hydrocarbon liquid, (C) cooling the dispersion containing 10% or more by weight solids in said vessel to permit precipitation of the resin out of the dispersant, the particulate media being maintained in continuous movement during and subsequent to cooling whereby toner particles having an average particle size of 10 μm or less are formed, and (D) separating the dispersion of toner particles from the particulate media.

Electrostatic developers are prepared by the addition of a charge director compound. The liquid developers are useful for preparation of copies and proofs of various colors and result in images having a higher gloss.

32 Claims, No Drawings

PROCESS FOR PREPARING HIGH GLOSS ELECTROSTATIC LIQUID DEVELOPERS

DESCRIPTION

1. TECHNICAL FIELD

This invention relates to an process for the preparation of toner particles. More particularly this invention relates to a process for the preparation of toner particles for electrostatic liquid developers which upon fusing to a substrate results in high gloss images

2. BACKGROUND OF THE INVENTION

It is known to develop a latent electrostatic image with toner particles dispersed in an insulating nonpolar liquid. Such dispersed materials are known as liquid toners or liquid developers. A latent electrostatic image may be produced by providing a photoconductive layer with a uniform electrostatic charge and subsequently discharging the electrostatic charge by exposing it to a modulated beam of radiant energy. Other methods are known for forming latent electrostatic images. For example, one method is providing a carrier with a dielectric surface and transferring a preformed electrostatic charge to the surface. Useful liquid developers comprise a thermoplastic resin and nonpolar liquid. Generally a suitable colorant is present such as a dye or pigment. The colored toner particles are dispersed in the nonpolar liquid which generally has a high-volume resistivity in excess of $10^9$ ohm centimeters, a low dielectric constant below 3.0 and a high vapor pressure. The average particle size of the toner particles is 21 30 μm determined for example by a Malvern 3600E Particle Sizer described below. After the latent electrostatic image has been formed the image is developed by the colored toner particles dispersed in said nonpolar liquid and the image may subsequently be transferred to a carrier sheet.

There are many methods of making liquid developers. In one such method of preparation toner particles are prepared by dissolving at an elevated temperature one or more polymers in a nonpolar dispersant, together with particles of a pigment, e.g., carbon black. The solution is cooled slowly, while stirring, whereby precipitation of particles occurs. It has been found that by repeating the above process some material was observed that was greater than 1 mm in size. By increasing the ratio of solids to nonpolar liquid the toner particles can be controlled within the desired size range, but it has been found that the density of images produced may be relatively low and when transfer of an image is made to a carrier sheet, for example, the amount of image transferred thereto may be relatively low. The particles in this process are formed by a precipitation mechanism and not grinding in the presence of particulate media and this contributes to the formation of an inferior liquid developer.

In another method of preparation of toner particles, the plasticizing of the thermoplastic polymer and pigment with a nonpolar liquid forms a gel or solid mass which is shredded into pieces, nore nonpolar liquid is added, the pieces are wet-ground into particles, and grinding is continued which is believed to pull the particles apart to form fibers extending therefrom. While this process is useful in preparing improved toners, it requires long cycle times and excessive material handling, i.e., several pieces of equipment are used.

Electrostatic liquid developers have been prepared in a single apparatus by a method as described in Larson U.S. Pat. No. 4,760,009. This method can provide toner particles with a particle size in 10 μm or less as determined by Malvern 3600E Particle Sizer but requires relatively long grinding times to achieve this desired particle size.

Yet another method known for the preparation of toner particles for electrostatic liquid developers comprises:

A. dispersing at an elevated temperature in a vessel a thermoplastic resin, optionally a colorant, and a hydrocarbon liquid having a Kauri-butanol value of less than 120, such that the dispersion contains a total % solids of at least 22% by weight by means of moving particulate media whereby the moving particulate media creates shear and/or impact, while maintaining the temperature in the vessel at a temperature sufficient to plasticize and liquify the resin and below that at which the hydrocarbon liquid boils and the resin and colorant, if present decomposes, B. cooling the dispersion containing a total % solids of at least 22% by weight in said vessel to permit precipitation of the resin out of the dispersant, the particulate media being maintained in continuous movement during and subsequent to cooling whereby toner particles having an average by area particle size of 10 μm or less, and C. separating the dispersion of toner particles from the particulate media. Using this process results in the preparation of liquid developers more quickly than by previously known methods using similar equipment but it has been found that in using such electrostatic liquid developers some pigments result in toner particles having low gloss on fusing to a substrate such as paper.

It has been found that the above disadvantages can be overcome and toner particles prepared by a process that does not require excessive handling of toner ingredients at elevated temperatures whereby toner particles having an average particle size of 10 μm or less determined by Malvern 3600E Particle Sizer are dispersed and formed in the same vessel with reduced grinding times. Transfer of an image of the so prepared toner particles to a carrier sheet results in transfer of a substantial amount of the image providing a suitably dense copy or reproduction. The fused images are also found to have improved gloss, better color strength, increased process latitude, i.e., no color shifts because pigment is well dispersed and stable; reduced background stain, improved dot resolution and transfer latitude, and require a lower developed mass to reach a given density.

SUMMARY OF THE INVENTION

In accordance with this invention there is provided a process for the preparation of toner particles for electrostatic liquid developers, which upon fusing to paper have a gloss ≧10 units over the paper gloss comprising:

(A) dispersing at least one thermoplastic resin, at least one pigment, and a hydrocarbon liquid having a Kauri-butanol value of less than 120, such that the dispersion contains a total percent solids of at least 10% by weight by means of particulate media whereby the moving particulate media creates shear and/or impact while maintaining the temperature for 5 to 180 minutes in the vessel at a temperature of at least 15° C. above the point at which the resin is plasticized or liquified by the hydrocarbon liquid and below that at which the hydrocarbon liquid boils and the resin and/or pigment decomposes, (B) continuing dispersion of the resin, pigment and hydrocarbon liquid as in Step (A) while maintaining the temperature for 5 to 180 minutes in the vessel in the range of at least 5° C. below the point to at least 10° C. above the point at which the resin is no longer plasticized or liquified by the hydrocarbon liquid, (C) cooling the dispersion containing a total % solids of at least 10% by weight in said vessel to permit precipitation of the resin out of the dispersant, the particulate media being maintained in continuous movement during and subsequent to cooling whereby toner particles having an average particle size of 10 μm or less are formed, and (D) separating the dispersion of toner particles from the particulate media.

DETAILED DESCRIPTION OF THE INVENTION

The process of this invention results in toner particles adapted for electrophoretic movement through a hydrocarbon liquid, generally a nonpolar liquid.

The toner particles are prepared from at least one thermoplastic polymer or resin, suitable pigments, and hydrocarbon dispersant liquids as described in more detail below. Additional components can be added, e.g., charge director, adjuvants, polyethylene, fine particle size oxides such as silica, etc.

The dispersant hydrocarbon liquids are, preferably, nonpolar branched-chain aliphatic hydrocarbons and more particularly, Isopar ®-G, Isopar ®-H, Isopar ®-K, Isopar ®-L, Isopar ®-M and Isopar ®-V. These hydrocarbon liquids are narrow cuts of isoparaffinic hydrocarbon fractions with extremely high levels of purity. For example, the boiling range of Isopar ®-G is between 157° C. and 176° C., Isopar ®-H between 176° C. and 191° C., Isopar ®-K between 177° C. and 197° C., Isopar ®-L between 188° C. and 206° C. and Isopar ®-M between 207° C. and 254° C. and Isopar ®-V between 254.4° C. and 329.4° C. Isopar ®-L has a mid-boiling point of approximately 194° C. Isopar ®-M has a flash point of 80° C. and an auto-ignition temperature of 338° C. Stringent manufacturing specifications, such as sulphur, acids, carboxyl, and chlorides are limited to a few parts per million. They are substantially odorless, possessing only a very mild paraffinic odor. They have excellent odor stability and are all manufactured by the Exxon Corporation. High-purity normal paraffinic liquids, Norpar ®12, Norpar ®13 and Norpar ®15, Exxon Corporation, may be used. These hydrocarbon liquids have the following flash points and auto-ignition temperatures:

| Liquid | Flash Point (°C.) | Auto-Ignition Temp (°C.) |
|---|---|---|
| Norpar ® 12 | 69 | 204 |
| Norpar ® 13 | 93 | 210 |
| Norpar ® 15 | 118 | 210 |

Additional useful hydrocarbon liquids Aromatic ®100, Aromatic ®150 and Aromatic ®200, manufactured by Exxon Corp., Houston, TX. These liquid hydrocarbons have the following Kauri-butanol values (ASTM D1133), flash point, TTC, ° C. (ASTM D56), and vapor pressure, kPa at 38° C. (ASTM D2879).

| Liquid | Kauri-Butanol | Flash Point | Vapor Pressure |
|---|---|---|---|
| Aromatic ® 100 | 91 | 43° C. | 1.7 |
| Aromatic ® 150 | 95 | 66° C. | 0.5 |
| Aromatic ® 200 | 95 | 103° C. | 0.17 |

All of the dispersant hydrocarbon liquids have an electrical volume resistivity in excess of 10 ohm centimeters and a dielectric constant below 3.0. The vapor pressures at 25° C. are less than 10 Torr. Isopar ®-G has a flash point, determined by the tag closed cup method, of 40° C., Isopar ®-H has a flash point of 53° C. determined by ASTM D56. Isopar ®-L and Isopar ®-M have flash points of 61° C., and 80° C., respectively, determined by the same method. While these are the preferred dispersant nonpolar liquids, the essential characteristics of all suitable dispersant hydrocarbon liquids are the electrical volume resistivity and the dielectric constant. In addition, a feature of the dispersant nonpolar liquids is a low Kauri-butanol value less than 30, preferably in the vicinity of 27 or 28, determined by ASTM D1133. The ratio of resin to dispersant hydrocarbon liquid is such that the combination of ingredients becomes plasticized or liquified at the working temperature. The plasticization or liquification temperature of the resin by the hydrocarbon is easily determined by one having ordinary skill in the art. In the process described above and prior to any dilution, the hydrocarbon liquid is present in an amount of 5 to 90% by weight, preferably 30 to 80% by weight, based on the total weight of liquid developer. The total weight of solids in the liquid developer is 10 to 95%, preferably 20 to 70% by weight. The total weight of solids in the liquid developer is solely based on the resin, including components dispersed therein, e.g., pigment component, adjuvant, etc.

Useful thermoplastic resins or polymers include: ethylene vinyl acetate (EVA) copolymers (Elvax ®resins, E. I. du Pont de Nemours and Company, Wilmington, DE), copolymers of ethylene and an α,β-ethylenically unsaturated acid selected from the group consisting of acrylic acid and methacrylic acid, copolymers of ethylene (80 to 99.9%)/acrylic or methacrylic acid (20 to 0%)/alkyl (C1to C5) ester of methacrylic or acrylic acid (0 to 20%), the percentages being by weight; polyethylene, polystyrene, isotactic polypropylene (crystalline), ethylene ethyl acrylate series sold under the trademark Bakelite ®DPD 6169, DPDA 6182 Natural and DTDA 9169 Natural by Union Carbide Corp., Stamford, CN; ethylene vinyl acetate resins, e.g., DQDA 6479 Natural and DQDA 6832 Natural 7 also sold by Union Carbide Corp.; Surlyn ®ionomer resin by E. I. du Pont de Nemours and Company, Wilmington, DE, etc., or blends thereof. Preferred copolymers are the copolymer of ethylene and an α,β-ethylenically unsaturated acid of either acrylic acid or methacrylic acid. The synthesis of copolymers of this type are described in Rees U.S. Pat. No. 3,264,272, the disclosure of which is incorporated herein by reference. For the purposes of preparing the preferred copolymers, the reaction of the acid containing copolymer with the ionizable metal compound, as described in the Rees patent, is omitted. The ethylene constituent is present in about 80 to 99.9% by weight of the copolymer and the acid component in about 20 to 0.1% by weight of the copolymer. The acid numbers of the copolymers range from 1 to 120, preferably 54 to 90. Acid No. is milligrams potassium hydroxide required to neutralize 1 gram of polymer. The melt index (g/10 min) of 10 to 500 is determined by ASTM D 1238, Procedure A. Particularly preferred copolymers of this type have an acid number of 66 and 54 and a melt index of 100 and 500 determined at 190° C., respectively.

In addition, the resins have the following preferred characteristics:

1. Be able to disperse the adjuvant, e.g., metallic soap, pigment, etc.
2. Be substantially insoluble in the dispersant liquid at temperatures below 40° C., so that the resin will not dissolve or solvate in storage,
3. Be able to solvate at temperatures above 50° C.,
4. Be able to be ground to form particles between 0.1 μm and 3.6 μm, in diameter preferred size), e.g., determined by Horiba CAPA-500 centrifugal automatic particle analyzer, manufactured by Horiba Instruments, Inc., Irvine, CA; and between 1 μm and 10 μm, in diameter, e.g., determined by Malvern 3600E Particle Sizer, manufactured by Malvern, Southborough, MA,
5. Be able to form a particle (average by area) of 6 μm or less, e.g., determined by Horiba CAPA-500 centrifugal automatic particle analyzer, manufactured by Horiba Instruments, Inc., Irvine, CA: solvent viscosity of 1.24 cps, solvent density of 0.76 g/cc, sample density of 1.32 using a centrifugal rotation of 1,000 rpm, a particle size range of 0.01 μm to less than 3.6 μm, and a particle size cut of 1.0 μm, and 10 μm average particle size determined by Malvern 3600E Particle Sizer, as described above,
6. Be able to fuse at temperatures in excess of 70° C.

By solvation in 3. above, the resins forming the toner particles will become swollen or gelatinous.

One or more charge directors as known to those skilled in the art can be added to impart a charge, as desired. Suitable hydrocarbon liquid soluble ionic or zwitterionic charge director compounds, which are generally used in an amount of 0.25 to 1,500 mg/g, preferably 2.5 to 400 mg/g developer solids, include: lecithin, Basic Calcium Petronate®, Basic Barium Petronate®, Neutral Barium Petronate, oil-soluble petroleum sulfonate, manufactured by Sonneborn Division of Witco Corp., New York, NY; alkyl succinimide (manufactured by Chevron Chemical Company of California), etc.; sodium dioctylsulfo succinate (manufactured by American Cyanamid Co.), ionic charge directors such as zirconium octoate, copper oleate, iron naphthenate, etc.; nonionic charge directors, e.g., polyethylene glycol sorbitan stearate, nigrosine, triphenyl methane type dyes and Emphos®D70-30C. and Emphos®F-27-85, sold by Witco Corp., New York, NY, sodium salts of phosphated mono- and diglycerides with unsaturated and saturated acid substituents, respectively.

As indicated above, the pigment is dispersed in the resin and renders the latent image visible. The pigment may be present in the amount of up to about 60 percent by weight based on the total weight of developer solids, preferably 0.01 to 30% by weight based on the total weight of developer solids. The amount of pigment may vary depending on the use of the developer. Examples of pigments include:

Pigment List

| Pigment Brand Name | Manufacturer | Colour Index Pigment |
|---|---|---|
| Permanent Yellow DHG | Hoechst | Yellow 12 |
| Permanent Yellow GR | Hoechst | Yellow 13 |
| Permanent Yellow G | Hoechst | Yellow 14 |
| Permanent Yellow NCG-71 | Hoechst | Yellow 16 |
| Permanent Yellow GG | Hoechst | Yellow 17 |
| Hansa Yellow RA | Hoechst | Yellow 73 |
| Hansa Brilliant Yellow 5GX-02 | Hoechst | Yellow 74 |
| Dalamar ® Yellow YT-858-D | Heubach | Yellow 74 |
| Hansa Yellow X | Hoechst | Yellow 75 |
| Novoperm ® Yellow HR | Hoechst | Yellow 83 |
| Chromophtal ® Yellow 3G | Ciba-Geigy | Yellow 93 |
| Chromophtal ® Yellow GR | Ciba-Geigy | Yellow 95 |
| Novoperm ® Yellow FGL | Hoechst | Yellow 97 |
| Hansa Brilliant Yellow 10GX | Hoechst | Yellow 98 |
| Lumogen ® Light Yellow | BASF | Yellow 110 |
| Permanent Yellow G3R-01 | Hoechst | Yellow 114 |
| Chromophtal ® Yellow 8G | Ciba-Geigy | Yellow 128 |
| Irgazin ® Yellow 5GT | Ciba-Geigy | Yellow 129 |
| Hostaperm ® Yellow H4G | Hoechst | Yellow 151 |
| Hostaperm ® Yellow H3G | Hoechst | Yellow 154 |
| Sico Fast ® Yellow D 1155 | BASF | Yellow 185 |
| L74-1357 Yellow | Sun Chem. | Yellow 14 |
| L75-1331 Yellow | Sun Chem. | Yellow 17 |
| L75-2337 Yellow | Sun Chem. | Yellow 83 |
| Hostaperm ® Orange GR | Hoechst | Orange 43 |
| Paliogen ® Orange | BASF | Orange 51 |
| Irgalite ® Red C2B | Ciba-Geigy | Red 48:2 |
| Irgalite ® Rubine 4BL | Ciba-Geigy | Red 57:1 |
| Quindo ® Magenta | Mobay | Red 122 |
| Indofast ® Brilliant Scarlet | Mobay | Red 123 |
| Hostaperm ® Scarlet GO | Hoechst | Red 168 |
| Permanent Rubine F6B | Hoechst | Red 184 |
| Monastral ® Magenta | Ciba-Geigy | Red 202 |
| Monastral ® Scarlet | Ciba-Geigy | Red 207 |
| Heliogen ® Blue L 6901F | BASF | Blue 15:2 |
| Heliogen ® Blue NBD 7010 | BASF | Blue:3 |
| Heliogen ® Blue K 7090 | BASF | Blue 15:3 |
| Heliogen ® Blue L 7101F | BASF | Blue 15:4 |
| Paliogen ® Blue L 6470 | BASF | Blue 60 |
| Heliogen ® Green K 8683 | BASF | Green 7 |
| Heliogen ® Green L 9140 | BASF | Green 36 |
| Monastral ® Violet R | Ciba-Geigy | Violet 19 |
| Monastral ® Red B | Ciba-Geigy | Violet 19 |
| Quindo ® Red R6700 | Mobay | Violet 19 |
| Quindo ® Red R6713 | Mobay | |
| Indofast ® Violet | Mobay | Violet 23 |
| Monastral ® Violet Maroon B | Ciba-Geigy | Violet 42 |
| Sterling ® NS Black | Cabot | Black 7 |
| Sterling ® NSX 76 | Cabot | |
| Tipure ® R-101 | Du Pont | White 6 |

While practically any pigment can be used in preparing the electrostatic liquid developers according to the invention, it has been found that not all pigments may show a substantial increase in gloss. By gloss is meant the ratio of specular reflected incident light measured at a 75° angle as per The Technical Procedure 7480. Preferred pigments which show improved gloss include: Quindo®Red R 6700, Quindo®Red R 6713, L74-1357 Yellow, Sico Fast®Yellow D 1155, and Irgalite®Red C2B, set out in the Pigment List above.

Other ingredients may be added to the electrostatic liquid developer, such as fine particle size oxides, e.g., silica, alumina, titania, etc.; preferably in the order of 0.5 μm or less can be dispersed into the liquefied resin. These optical oxides can be used as the pigment or in combination with the pigment. Metal particles can also be added.

Another additional component of the electrostatic liquid developer is an adjuvant which can be selected from the group of polyhydroxy compound which contains at least 2 hydroxy groups, aminoalcohol, polybutylene succinimide, metallic soap, and aromatic hydrocarbon having a Kauri-butanol value of greater than 30. The adjuvants are generally used in an amount of 1 to 1,000 mg/g, preferably 1 to 200 mg/g developer solids. Examples of the variousa above-described adjuvants include:

polyhydroxy compounds: ethylene glycol, 2,4,7,9-tetramethyl-5-decyn-4, 7-dion, poly(propylene glycol), pentaethylene glycol, tripropylene glycol, triethylene glycol, glycerol, pentaerythritol, glycerol-tri-12 hydroxystearate, ethylene glycol monohydroxystearate, propylene glycerol monohydroxy-stearate, etc., described in Mitchell U.S. Pat. No. 4,734,352;

aminoalcohol compounds: triisopropanolamine, triethanolamine, ethanolamine, 3-amino-1-propanol, o-aminophenol, 5-amino-1-pentanol, tetra(2hydroxyethyl-)ethylenediamine, etc., described in Larson U.S. Pat. No. 4,702,985;

polybutylene succinimide: OLOA ®-1200 sold by Chevron Corp., analysis information appears in Kosel U.S. Pat. No. 3,900,412, column 20, lines 5 to 13, incorporated herein by reference; Amoco 575 having a number average molecular weight of about 600 (vapor pressure osmometry) made by reacting maleic anhydride with polybutene to give an alkenylsuccinic anhydride which in turn is reacted with a polyamine. Amoco 575 is 40 to 45% surfactant, 36% aromatic hydrocarbon, and the remainder oil, etc., described in El-Sayed and Taggi U.S. Pat. No. 4,702,984;

metallic soap: aluminum tristearate; aluminum distearate; barium, calcium, lead and zinc stearates; cobalt, manganese, lead and zinc linoleates; aluminum, calcium and cobalt octoates; calcium and cobalt oleates; zinc palmitate; calcium cobalt, manganese, lead and zinc naphthenates; calcium, cobalt, manganese, lead and zinc resinates; etc. The metallic soap is dispersed in the thermoplastic resin as described in Trout U.S. Pat. No. 4,707,429; and aromatic hydrocarbon: benzene, toluene, naphthalene, substituted benzene and naphthalene compounds, e.g., trimethylbenzene, xylene, dimethylethylbenzene, ethylmethylbenzene, propylbenzene, Aromatic ®100 which is a mixture of C9 and C10 alkyl substituted benzenes manufactured by Exxon Corp., described in Mitchell U.S. Pat. No. 4,663,264, etc. The disclosures of the aforementioned U.S. patents are incorporated herein by reference.

The particles in the electrostatic liquid developer preferably have an average particle size 10 μm or less. The average particle size determined by the Malvern 600E Particle Sizer can vary depending on the use of the liquid developer. The resin particles of the developer may or may not be formed having a plurality of fibers integrally extending therefrom although the formation of fibers extending from the toner particles is preferred. The term "fibers" as used herein means pigmented toner particles formed with fibers, tendrils, tentacles, threadlets, fibrils, ligaments, hairs, bristles, or the like.

In carrying out the process of the invention, a suitable mixing or blending vessel, e.g., attritor, heated ball mill, heated vibratory mill such as a Sweco Mill manufactured by Sweco Co., Los Angeles, CA, equipped with particulate media, for dispersing and grinding, etc., is used. Generally the resin, pigment, and dispersant hydrocarbon liquid are placed in the vessel prior to starting the dispersing step at a percent solids of 10 to 95%, preferably 20 to 70% by weight. Optionally the pigment can be added after hom'ogenizing the resin and the dispersant hydrocarbon liquid. Polar additive similar to that described in Mitchell, U.S. Pat. No. 4,631,244 can also be present in the vessel, e.g., up to 100% based on the weight of polar additive and dispersant hydrocarbon liquid. The dispersing is generally accomplished in two steps at two different elevated temperature levels, the first being a temperature of at least 15° C. above the point at which the resin is plasticized or liquified by the hydrocarbon liquid but below that at which the hydrocarbon liquid or polar additive, if present, boils and the resin decomposes and the second step being at a temperature of at least 5° C. below the point at which the resin is no longer plasticized or liquified by the hydrocarbon liquid to a temperature of at least 10° C. above the point at which the resin is no longer plasticized or liquified by the hydrocarbon liquid. The first dispersing step may be accomplished in 5 to 180 minutes, preferably, 15 to 30 minutes, while the second step may be accomplished in 5 to 180 minutes, preferably 15 to 45 minutes. Preferred temperature ranges are 90 to 105° C. and 65 to 80° C. for Steps A and B, respectively. Other temperatures outside this range may be suitable, however, depending on the particular ingredients used and providing they meet the above enumerated requirements. The presence of the irregularly moving particulate media in the vessel is needed to prepare the dispersion of toner particles. It has been found that stirring the ingredients, even at a high rate, is not sufficient to prepare dispersed toner particles of proper size, configuration and morphology. Useful particulate media are particulate materials, e.g., spherical, cylindrical, etc., selected from the group consisting of stainless steel, carbon steel, alumina, ceramic, zirconia, silica, and sillimanite. Carbon steel particulate media is particularly useful when colorants other than black are used. A typical diameter range for the particulate media is in the range of 0.04 to 0.5 inch (1.0 to approx. 13 mm).

After dispersing the ingredients in the vessel, with or without a polar additive present, until the desired dispersion is achieved, typically 0.5 to 1.5 hours for both dispersing steps, with the mixture being fluid, the dispersion is cooled to permit precipitation of the resin out of the dispersant. Cooling is accomplished in the same vessel, such as the attritor, while simultaneously grinding with particulate media to prevent the formation of a gel or solid mass. Cooling is accomplished by means known to those skilled in the art and is not limited to cooling by circulating cold water or a cooling material through an external cooling jacket adjacent to the dispersing apparatus or permitting the dispersion to cool to ambient temperature. The resin precipitates out of the dispersant during the cooling. Typical cooling temperatures may range from 15° C. to 50° C. Toner particles of average particle size of 10 μm or less, as determined by a Malvern 3600E Particle Sizer, 3.6 μm or less as determined using the Horiba centrifugal particle analyzer described above, or other comparable apparatus, are formed by grinding for a relatively short period of time when compared with former methods. It is preferred that the desired particle size be achieved within a normal work period, e.g., 8 hours or less, preferably 4 hours or less.

The Malvern 3600E Particle Sizer manufactured by Malvern, Southborough, MA uses laser diffraction light scattering of stirred samples to determine average particle sizes. Since the Horiba and Malvern instruments use different techniques to measure average particle size the readings differ. The following correlation of the average size of toner particles in micrometers (μm) for the two instruments is:

| Value Determined By Malvern 3600E Particle Sizer | Expected Range For Horiba CAPA-500 |
|---|---|
| 30 | 9.9 ± 3.4 |
| 20 | 6.4 ± 1.9 |
| 15 | 4.6 ± 1.3 |
| 10 | 2.8 ± 0.8 |
| 5 | 1.0 ± 0.5 |
| 3 | 0.2 ± 0.6 |

This correlation is obtained by statistical analysis of average particle sizes for 67 liquid electrostatic developer samples (not of this invention) obtained on both instruments. The expected range of Horiba values was determined using a linear regression at a confidence level of 95%. In the claims appended to this specification the particle size values are as measured using the Malvern instrument.

After cooling and separating the dispersion of toner particles from the particulate media by means known to those skilled in the art, it is possible to reduce the concentration of the toner particles in the dispersion, impart an electrostatic charge of predetermined polarity to the toner particles, or a combination of these variations. The concentration of the toner particles in the dispersion is reduced by the addition of additional dispersant hydrocarbon liquid as described previously above. The dilution is normally conducted to reduce the concentration of toner particles to between 0.1 to 10 percent by weight, preferably 0.3 to 4.0, and more preferably 0.5 to 2 weight percent with respect to the dispersant hydrocarbon liquid. One or more hydrocarbon liquid soluble ionic or zwitterionic charge director compounds of the type set out above, can be added to impart a positive or negative charge, as desired. The addition may occur at any time during the process; preferably at the end of the process, e.g., after the particulate media are removed and the dilution of toner particles is accomplished. If a diluting dispersant hydrocarbon liquid is also added, the ionic or zwitterionic compound can be added prior to, concurrently with, or subsequent thereto. If an adjuvant compound of a type described above has not been previously added in the preparation of the developer, it can be added prior to or subsequent to the developer being charged. Preferably the adjuvant compound is added after the dispersing step.

INDUSTRIAL APPLICABILITY

The improved process of this invention produces a liquid electrostatic developer which may have a plurality of fibers extending from the toner particles. The liquid developer contains toner particles having a controlled particle size range which can be prepared more quickly than by previously known processes using similar equipment for making liquid electrostatic developers and which upon fusing result in images having high gloss. The developer is of the liquid type and is particularly useful in copying, e.g., making office copies of black and white as well as various colors; or color proofing, e.g., a reproduction of an image using the standard colors: yellow, cyan and magenta together with black as desired. In copying and proofing the toner particles are applied to a latent electrostatic image. Other uses are envisioned for the improved toner particles, e.g., the formation of copies or images using toner particles containing finely divided ferromagnetic materials or metal powders; conductive lines using toners containing conductive materials, resistors, capacitors and other electronic components; lithographic printing plates, etc.

EXAMPLES

The following examples wherein the parts and percentages are by weight illustrate but do not limit the invention. In the examples the melt indices were determined by ASTM D 1238, Procedure A, the average particle sizes by area were determined by a Malvern 3600E Particle Sizer, manufactured by Malvern, Southborough, MA, as described above, the conductivity was measured in picomhos/cm (pmhos) at 5 hertz and low voltage, 5 volts, and the density was measured using a Macbeth densitometer model RD918. Specular gloss was measured at a 75 degree angle using a Glossgard II ®glossmeter, Pacific Scientific, Silver Spring, MD calibrated to a white tile with a gloss value of 49.1 and a black glass with a gloss value of 100

EXAMPLE 1

Toner samples were prepared using the following procedures:

A yellow toner (Sample 1-Control) was prepared by adding 370 g of a copolymer of ethylene (91%) and methacrylic acid (9%), melt index at 190° C. is 500, acid No. is 60, 51 g of a yellow pigment, Sico Fast ® Yellow D 1155, BASF, Holland, MI, 4.3 grams of aluminum tristearate, and 1020 g of Isopar ®-L to a Union Process IS attritor, Union Process Co., Akron, OH, charged with 0.1857 inch (4.76 mm) diameter carbon steel balls. The mixture was milled at 90° C. for 1 hour, cooled to 20° C., an additional 600 g of Isopar ®-L was added, and milled for another 2 hours. The average measured particle size was 10.4 μm.

A second yellow toner (Sample 2 - Control) was prepared by the procedure described for Sample 1 with the following exceptions: the milling step of 1 hour at 90° C. was replaced by milling at 75° C. for 1 hour. The mixture was cooled to approximately 20° C. and an additional 600 grams of Isopar ®-L were added. After grinding for two more hours the average measured particle size was 8.9 μm.

A third yellow toner (Sample 3 - Control) was prepared by the procedure described for Sample 1 with the following exceptions: the milling step of 1 hour at 90° C. was replaced by milling at 75° C. for 3 hours. The mixture was cooled to approximately 20° C. and an additional 600 grams of Isopar ®-L were added. After grinding for two more hours the average measured particle size was 10.1 μm.

A fourth yellow toner (Sample 4) was prepared by the procedure described for Sample 1 with the following exceptions: the milling step of 1 hour at 90° C. was replaced by milling at 90° C. for 30 minutes followed by milling an additional 30 minutes at 75° C. The mixture was cooled to approximately 20° C. and an additional 530 grams of Isopar ®-L were added. After grinding for two more hours the average measured particle size was 6.6 μm.

Samples 1–4 were evaluated using the following procedure: toner concentration was adjusted to approximately 10%, and drawdowns on Text Web paper, Champion Papers, Inc., Stamford CT, were done using a Laboratory Drawdown Machine, Paul N. Gardner Co. Inc., Pompano Beach, FL. Image density was varied from 1.0 to 1.6 by using a series of metering rods, #5 to #25, Consler Scientific Design, Tampa, FL or by diluting the toner with additional Isopar ®-L to either 5% or 7% solids. The images were fused at 120° C. for 1 minute in a Fisher Isotemp Oven, Model 281. Density and gloss were measured. A linear regression of gloss vs. density data was used to calculate the gloss at absolute density 1.4. The two step hot grind process at 90° C. and 75° C. for a yellow toner made with an acidic polyethylene resin exhibited higher gloss than a single step hot grind at either 75° C. or 90° C. for the same time, or an extended grind at 75° C. Results are shown in Table 1 below.

TABLE 1

| Toner | Gloss |
|---|---|
| Sample 1 (Control) | 51 |
| Sample 2 (Control) | 56 |
| Sample 3 (Control) | 58 |
| Sample 4 | 64 |

EXAMPLE 2

A yellow toner (Sample 5 - Control) was prepared by the procedure described for Sample 1 with the following exceptions: the milling step of 1 hour at 90° C. was replaced by milling at 60° C. for 1 hour. The mixture was cooled to approximately 20° C. and an additional 600 grams of Isopar ®-L were added. After grinding for two more hours the average particle size was not measured. Large amounts of unmelted resin beads approximately 0.5 cm across were present.

Another yellow toner (Sample 6 - Control) was prepared by the procedure described for Sample 1 with the following exceptions: the milling step of 1 hour at 90° C. was replaced by milling at 100° C. for 1 hour. The mixture was cooled to approximately 20° C. and an additional 530 grams of Isopar ®-L were added. After grinding for two more hours the average measured particle size was 6.5 μm.

Another yellow toner (Sample 7 - Control) was prepared by the procedure described for Sample 1 with the following exceptions: the milling step of 1 hour at 90° C. was replaced by milling at 100° C. for 3 hours. The mixture was cooled to approximately 20° C. and an additional 600 grams of Isopar ®-L were added. After grinding for two more hours the average measured particle size was 6.5 μm.

Another yellow toner (Sample 8) was prepared by the procedure described for Sample 1 with the following exceptions: the milling step of 1 hour at 90° C. was replaced by milling at 100° C. for 15 minutes followed by milling an additional 45 minutes at 60° C. The mixture was cooled to approximately 20° C. and an additional 600 grams of Isopar ®-L were added. After grinding for two more hours the average measured particle size was 6.4 μm.

Samples.5–8 were evaluated as described in Example 1 with the following exceptions: drawdowns were done on Phoenograand ®paper, Scheufelen, W. Germany. The images were fused at 140° C. for two minutes in a Fisher Isotemp Oven, Model 281. The two step hot grind process at 100° and 60° C. for a yellow toner made with an acidic polyethylene resin exhibited higher gloss than the single step hot grind at either 100° C. for the same time or an extended grind at 100° C. At 60° C. it was not possible to make a toner. Results are shown in Table 2 below.

TABLE 2

| Toner | Gloss |
|---|---|
| Sample 5 (Control) | — |
| Sample 6 (Control) | 49 |
| Sample 7 (Control) | 56 |
| Sample 8 | 59 |

EXAMPLE 3

A magenta toner (Sample 9 - Control) was prepared by the procedure described for Sample 1 with the following exceptions: Quindo ®Red R6700, Mobay Corporation, Dyes and Pigments Organics Division, Pittsburgh, PA, was used in place of the yellow pigment. In addition the milling step of 1 hour at 90° C. was prepared by the procedure described for Sample 9 with the following exception: the milling step of 1 hour at 100° C. was replaced by milling at 75° C. for one hour. The average measured particle size was 7.4 μm.

Another magenta toner (Sample 11) was prepared by the procedure described for Sample 9 with the following exception: the milling step of 1 hour at 100° C. was replaced by milling at 100° C. for 15 minutes followed by milling an additional 45 minutes at 75° C. The average measured particle size was 8.3 μm.

Samples 9–11 were evaluated as described in Example 1 with the exception that the fusing temperature was 130° C. Gloss was measured at an absolute density of 1.35. The two step hot grind process at 100° C. and 75° C. for a magenta toner made with an acidic polyethylene resin exhibited higher gloss than a single step hot grind at either 100° C. or 75° C. for the same time. Results are shown in Table 3 below.

TABLE 3

| Toner | Gloss |
|---|---|
| Sample 9 (Control) | 70 |
| Sample 10 (Control) | 72 |
| Sample 11 | 75 |

EXAMPLE 4

A yellow toner (Sample 12 - Control) was prepared by the procedure described for Sample 1 with the following exceptions: a copolymer of vinyl acetate (18%) and ethylene (82%), melt index 150, was used for the resin and 524 grams of Isopar ®-L were added at 20° C. The average measured particle size was 7.9 μm.

Another yellow toner (Sample 13 - Control) was prepared by the procedure described for Sample 2 with the following exceptions: a copolymer of vinyl acetate (18%) and ethylene (82%), melt index 150, was used for the resin and 524 grams of Isopar ®-L were added at 20° C. The average measured particle size was 8.6 μm.

Another yellow toner (Sample 14) was prepared by the procedure described for Sample 4 with the following exceptions: a copolymer of vinyl acetate (18%) and ethylene (82%), melt index 150, was used for the resin and 524 grams of Isopar ®-L were added at 20° C. The average measured particle size was 7.6 μm.

Samples 12 –14 were evaluated as described in Example 1. Gloss was measured at an absolute density of 1.35. The two step hot grind process at 100° C. and 75° C. for a yellow toner made with a vinyl acetate/ethylene copolymer resin exhibited higher gloss than a single step hot grind at either 100° C. or 75° C. for the same time. Results are shown in Table 4 below.

TABLE 4

| Toner | Gloss |
|---|---|
| Sample 12 (Control) | 46 |
| Sample 13 (Control) | 46 |
| Sample 14 | 75 |

A yellow toner (Sample 15) was prepared by the procedure described for Sample 1 with the following exceptions: the milling step of 1 hour at 90° C. was replaced by milling at 90° C. for 30 minutes followed by milling an additional 30 minutes at 75 C and 182 grams of Isopar ®-L were used in this step. The mixture was cooled to approximately 20° C. and an additional 1561 grams of Isopar ®-L were added. After grinding for two more hours the average measured particle size was 6.6 μm.

Samples 4 and 15 were evaluated as described in Example 1 with the exceptions that the developers were at 12% solids and the fusing temperature was 140° C. Gloss was measured at an absolute density of 1.23. The two step hot grind process at 70% solids exhibited higher gloss than the two step hot grind process at 29.4% solids. Results are shown in Table 5 below.

TABLE 5

| Toner | Gloss |
|---|---|
| Sample 4 | 51 |
| Sample 15 | 56 |

We claim:

1. A process for the preparation of toner particles for electrostatic liquid developers, which upon fusing to paper have a gloss ≧10 units over the paper gloss comprising:

(A) dispersing at least one thermoplastic resin, at least one pigment, and a hydrocarbon liquid having a Kauri-butanol value of less than 120, such that the dispersion contains a total percent solids of at least 10% by weight by means of particulate media whereby the moving particulate media creates shear and/or impact while maintaining the temperature for 5 to 180 minutes in the vessel at a temperature of at least 15° C. above the point at which the resin is plasticized or liquified by the hydrocarbon liquid and below that at which the hydrocarbon liquid boils and the resin and/or pigment decomposes, (B) continuing dispersion of the resin, pigment and hydrocarbon liquid as in Step (A) while maintaining the temperature for 5 to 180 minutes in the vessel in the range of at least 5° C. below the point to at least 10° C. above the point at which the resin is no longer plasticized or liquified by the hydrocarbon liquid, (C) cooling the dispersion containing a total solids of at least 10% by weight in said vessel to permit precipitation of the resin out of the dispersant, the particulate media being maintained in continuous movement during and subsequent to cooling whereby toner particles having an average particle size of 10 μm or less are formed, and (D) separating the dispersion of toner particles from the particulate media.

2. A process according to claim 1 wherein the temperature for Step (A) is in the range of 90 to 105° C. and the temperature for Step (B) is in the range of 65 to 80° C.

3. A process according to claim 1 wherein Step (A) is accomplished in 15 to 30 minutes.

4. A process according to claim 1 wherein Step (B) is accomplished in 15 to 45 minutes.

5. A process according to claim 1 wherein dispersion in Step (A) has a percent solids of 10 to 95%.

6. A process according to claim 1 wherein dispersion in Step (A) has a percent solids of 20 to 70° C.

7. A process according to claim 1 wherein the particulate media are selected from the group consisting of stainless steel, carbon steel, ceramic, alumina, zirconia, silica, and sillimanite.

8. A process according to claim 7 wherein the particulate media are spherical having an average diameter of 0.04 to 0.5 inch.

9. A process according to claim 1 wherein the thermoplastic resin is a copolymer of ethylene (80 to 99.9%)/acrylic or methacrylic acid (0 to 20%)/alkyl C1 to C5 ester of methacrylic or acrylic acid (0 to 20%), the percentages being by weight.

10. A process according to claim 9 wherein the thermoplastic resin is a copolymer of ethylene (89%) and methacrylic acid (11%) having a melt index at 190° C. of 100.

11. It A process according to claim 1 wherein the pigment is carbon black.

12. A process according to claim 1 wherein the pigment is a colored pigment.

13. A process according to claim 1 wherein a fine particle size oxide is present.

14. A process according to claim 13 wherein the oxide is silica.

15. A process according to claim 1 wherein a combination of pigments is present.

16. A process according to claim 1 wherein after Step (C) a charge director is added to the dispersion to impart an electrostatic charge of predetermined polarity to the toner particles.

17. A process according to claim 16 wherein the thermoplastic resin is a copolymer of ethylene (89%) and methacrylic acid (11%) having a melt index at 190° C. of 100.

18. A process according to claim 1 wherein a plurality of thermoplastic resins are employed in the plasticizing Step (A).

19. A process according to claim 1 wherein subsequent to Step (C) the dispersion is diluted with additional hydrocarbon liquid.

20. A process according to claim 19 wherein the thermoplastic resin is a copolymer of ethylene (89%) and methacrylic acid (11%) having a melt index at 190° C. of 100.

21. A process according to claim 19 wherein the dilution is conducted to reduce the concentration of toner particles to between 0.1 to 4.0 percent by weight with respect to the hydrocarbon liquid.

22. A process according to claim 1 wherein the particles have an average particle size of 5 μm or less.

23. A process according to claim 1 wherein toner particles having a plurality of fibers extending therefrom are formed in Step (B).

24. A process according to claim 16 wherein an adjuvant selected from the group consisting of polyhydroxy compound, aminoalcohol, polybutylene succinimide, metallic soap, and aromatic hydrocarbon having a Kauri-butanol value of greater than 30, with the proviso that the metallic soap is dispersed in the thermoplastic resin.

25. A process according to claim 24 wherein the adjuvant compound is added after the dispersing Step (A).

26. A process according to claim 1 wherein the hydrocarbon liquid has a Kauri-butanol value of less than 30.

27. A process according to claim 26 wherein the thermoplastic resin is a copolymer of ethylene and methacrylic acid.

28. A process according to claim 26 wherein at least one pigment is present.

29. A process according to claim 28 wherein after Step (C) a charge director is added to the dispersion.

30. A process according to claim 29 wherein the thermoplastic resin is a copolymer of ethylene and methacrylic acid.

31. A process according to claim 30 wherein subsequent to Step (C) diluting the dispersion with additional hydrocarbon liquid.

32. A process according to claim 31 wherein the toner particles having a plurality of fibers extending therefrom are formed in Step (B).

* * * * *